US007797867B2

(12) United States Patent
Pulliam

(10) Patent No.: US 7,797,867 B2
(45) Date of Patent: Sep. 21, 2010

(54) APPARATUS AND METHOD FOR RETAINING AND SELECTIVELY TENSIONING A SHEET MATERIAL DISPLAY TO A BILLBOARD

(76) Inventor: Michael Wayne Pulliam, 351 Exchange St., West Monroe, LA (US) 71292

( * ) Notice: Subject to any disclaimer, the term of this patent is extended or adjusted under 35 U.S.C. 154(b) by 65 days.

(21) Appl. No.: 12/321,272

(22) Filed: Jan. 20, 2009

(65) Prior Publication Data

US 2009/0172984 A1 Jul. 9, 2009

Related U.S. Application Data

(62) Division of application No. 10/988,665, filed on Nov. 15, 2004, now Pat. No. 7,500,325.

(51) Int. Cl.
*G09F 15/00* (2006.01)
*G09F 17/00* (2006.01)

(52) U.S. Cl. ..... 40/603; 40/599; 40/604; 40/606.14; 40/606.15; 160/327; 160/328

(58) Field of Classification Search ..... 40/60, 40/599, 604, 606.14, 606.153; 160/328, 160/327
See application file for complete search history.

(56) References Cited

U.S. PATENT DOCUMENTS 762,481 A 6/1904 Klipping
2,465,621 A 3/1949 Wheeler
2,554,542 A 5/1951 Rust et al.
2,625,995 A 1/1953 Rust et al.
2,632,507 A 3/1953 Ewing
2,678,691 A 5/1954 Rust et al.
4,580,361 A 4/1986 Hillstrom et al.
4,657,062 A * 4/1987 Tuerk ..... 160/243
5,099,590 A 3/1992 Yamaguchi
5,142,804 A 9/1992 Hillstrom et al.
5,159,770 A 11/1992 Yamaguchi
5,398,436 A 3/1995 Suzuki
5,647,155 A 7/1997 Hillstrom
5,893,226 A 4/1999 Sophocleous et al.
6,092,319 A 7/2000 Hicks
6,209,245 B1 4/2001 Wittenberg
6,250,002 B1 6/2001 Wittenberg
6,339,889 B1 1/2002 Griesemer et al.
6,564,488 B2 5/2003 Wittenberg
6,862,825 B1 3/2005 Lowndes
7,124,525 B2 10/2006 Green et al.

* cited by examiner

*Primary Examiner*—Lesley Morris
*Assistant Examiner*—Syed A Islam
(74) *Attorney, Agent, or Firm*—Jones Walker

(57) ABSTRACT

An apparatus for retaining and selectively tensioning a sheet material display on a billboard which includes a base plate, a handle connected to the base plate, a draw bar operationally associated with the handle, a spring detachably connected to the draw bar, and a chain with one end connected to the spring and the other end capable of being detachably connected to the sheet material display. The draw bar is selectively positioned about the handle in at least two different positions to exert a different amount of tension to the sheet material display when the handle is place in a sheet material display tensioned position.

5 Claims, 5 Drawing Sheets

APPARATUS AND METHOD FOR RETAINING AND SELECTIVELY TENSIONING A SHEET MATERIAL DISPLAY TO A BILLBOARD

CROSS-REFERENCE TO RELATED APPLICATIONS

This application is a divisional of and claims priority to U.S. patent application Ser. No. 10/988,665, filed on Nov. 15, 2004 now U.S. Pat. No. 7,500,325.

FIELD OF THE INVENTION

The present invention relates to an apparatus for retaining and tensioning a sheet material display to a billboard, and more particularly to an apparatus for retaining and selectively tensioning a sheet material display to a billboard. The present invention also relates to a method of retaining and selectively tensioning a sheet material display to a billboard.

BACKGROUND OF THE INVENTION

Among the various media used to convey advertising or public service messages, billboards remain popular. This is due in large part to the effectiveness of billboard advertising and accounts for the multitude of billboards which line most of the well traveled highways and secondary roads. Billboards can also be found on building rooftops and other locations where they can be seen by the consuming public.

Billboards come in different sizes. A common size used for highway and roadside placement contains a display face that is 14 feet high and 48 feet wide.

Most of the billboard advertising used today is generated on a large, flexible sheet of synthetic material, typically composed of reinforced nylon. The display message is usually painted or printed on the sheet material by a computer-assisted process. The sheet material display may be rolled onto a large roll. The roll is transported onsite to the billboard where a crane or other lifting device lifts the roll into position about the billboard. The sheet material display is then unrolled onto the front face of the billboard. The edge portions of the sheet material display extend around the front face of the billboard to the back face thereof. A rod is hemmed into the edge portions of the sheet material display with openings that expose sections of the rod.

The edges of the sheet material display are secured and tensioned typically by a number of ratchet strap devices. The ratchet strap device includes a strap with a hook attached at one end (the hook is designed to connect to the exposed rod) and a ratchet wheel mechanism for tightening the strap and thereby tensioning the sheet material display.

The ratchet strap device suffers from numerous drawbacks. The strap, which is typically made of a nylon material, is prone to wear. It is therefore customary to replace the ratchet strap device every year. As several ratchet strap devices are usually required to attach a sheet material display to a billboard, the replacement of such ratchet strap devices every year can be costly.

The ratchet strap device is also disadvantaged because it has limited ability to accommodate variations in billboard support structure. In instances where there is no billboard supporting structure upon which the strap at the opposite end from the ratchet mechanism can be secured, the strap is often secured to the structure by ropes, cables, or additional straps.

The ratchet strap device further has limited ability to adjust to the expansion and contraction properties of the sheet material display which may be caused by external conditions such as heat, wind, etc. Sheet material displays tensioned by ratchet strap devices tend to lose their fit appearance over time and require frequent onsite readjustment and tensioning.

The need therefore exists for a simple, easy to use, adjustable, and durable sheet material display retaining and tensioning apparatus.

SUMMARY OF THE INVENTION

It is an object of the present invention to provide a sheet material display retaining and tensioning apparatus that is quick and easy to install.

It is a further object of the present invention to provide a sheet material display retaining and tensioning apparatus that is durable.

It is a further object of the present invention to provide a sheet material display retaining and tensioning apparatus that maintains flexible tension and eliminates unnecessary call backs.

It is a further object of the present invention to provide a sheet material display retaining and tensioning apparatus that extends the life of the sheet material display.

These and other objects and advantages of the present invention are achieved by the novel apparatus for retaining and selectively tensioning a sheet material display on a billboard.

The apparatus may include a base plate capable of being affixed to the back face of the billboard.

The apparatus may include a handle that is preferably pivotally connected to the base plate by pivot connection means. The handle preferably has a sheet material display released position and a sheet material display tensioned position.

The pivot connection means preferably includes at least one handle connecting bracket. The handle connecting bracket preferably includes a rivet bore hole through which a rivet is placed to pivotally connect the handle to the handle connecting bracket.

The apparatus may include a draw bar operationally associated with the handle. Preferably, the draw bar is capable of being movably positioned about the handle in at least two different positions. Each of the at least two different positions is preferably capable of causing the draw bar to exert a different amount of tension to the sheet material display when the handle is placed in the sheet material display tensioned position. More preferably, the draw bar is capable of being movably positioned about the handle in at least three different positions. Each of the at least three different positions is preferably capable of causing the draw bar to exert a different amount of tension to the sheet material display when the handle is placed in the sheet material display tensioned position.

The apparatus may include a spring means that is preferably detachably connected to the draw bar. The spring means is preferably capable of providing constant tension to the sheet material display and to the handle when the handle is placed in the sheet material display tensioned position. The constant tension being provided to the handle is capable of maintaining the handle in the sheet material display tensioned position. The spring means preferably is a coiled spring.

The apparatus may include a chain preferably having a first end detachably connected to the spring means and a second end capable of being detachably connected to the sheet material display. The second end of the chain may include an S-hook. The S-hook is preferably capable of being detachably connected to the sheet material display. The S-hook is more preferably capable of being detachably connected to a connecting rod hemmed into the sheet material display at an outer edge thereof and partially exposed. The S-hook is also preferably capable of being looped around the connecting rod and attached to a second area of the chain.

The apparatus may include a handle locking means. The handle locking means is preferably capable of being operationally associated with the handle and the draw bar. The handle locking means is also preferably capable of preventing the handle from being placed in the sheet material released position once the handle is placed in the sheet material tensioned position.

In a preferred embodiment, the apparatus may include a base plate capable of being affixed to a back face of the billboard. The base plate may have a top face, a bottom face, and four interconnected side walls.

Preferably, the base plate includes at least one screw bore therein. The screw bore is preferably capable of permitting placement of a screw therein, tightening of the screw, and retention of a portion of the screw to cause the base plate to be detachably affixed to the back face of the billboard. More preferably, the base plate includes at least two screw bores therein. Each of the screw bores are preferably capable of permitting placement of a separate screw therein, tightening of the screw, and retention of a portion of the screw to cause the base plate to be detachably affixed to the back face of the billboard.

The preferred embodiment may include a first and second handle connecting brackets. Each of the first and second handle connecting brackets may have a distal end, a proximal end, an outer face, an inner face, and four interconnecting side walls. The proximal end of each of the first and second handle connecting brackets may be fixedly attached to the top face of the base plate so that the first and second handle connecting brackets are positioned perpendicular to the base plate in spaced-apart, parallel relation.

The preferred embodiment may include a U-shaped handle which preferably has first and second arms. Each of the first and second arms preferably has a distal end, a proximal end, an outer face, and an inner face. The distal end of the first arm of the handle is preferably pivotally connected to the distal end of the first handle connecting bracket and the distal end of the second arm of the handle is preferably pivotally connected to the distal end of the second handle connecting bracket so that the handle is capable of being pivoted from a sheet material display released position to a sheet material display tensioned position.

Preferably, the distal end of each of the first and second handle connecting brackets contains a rivet bore hole and the distal end of each of the first and second arms of the handle contains a corresponding rivet bore hole. The rivet bore hole of the distal end of the first handle connecting bracket is preferably aligned with the corresponding rivet bore hole of the distal end of the first arm of the handle. The rivet bore hole of the distal end of the second handle connecting bracket is preferably aligned with the corresponding rivet bore hole of the distal end of the second arm of the handle. A first rivet may be provided with a portion passing through the rivet bore hole of the distal end of the first handle connecting bracket and the corresponding rivet bore hole of the distal end of the first arm of the handle to pivotally connect the distal end of the first arm of the handle to the distal end of the first handle connecting bracket. A second rivet may be provided with a portion passing through the rivet bore hole of the distal end of the second handle connecting bracket and the corresponding rivet bore hole of the distal end of the second arm of the handle to pivotally connect the distal end of the second arm of the handle to the distal end of the second handle connecting bracket.

The preferred embodiment may include a draw bar operationally associated with the handle. The draw bar is preferably at least partially positioned between the inner face of the first arm of the handle and the inner face of the second arm of the handle. The draw bar may have a draw bar pin cutout for receiving a portion of the draw bar pin. The draw bar pin cutout is preferably capable of causing the draw bar to be movably positioned about the handle in at least two different positions. Each of the at least two different positions may be capable of causing the draw bar to exert a different amount of tension to the sheet material display when the handle is placed in the sheet material display tensional position.

Preferably, the draw bar pin extends from the inner face of the first arm of the handle through the draw bar pin cutout of the draw bar to the inner face of the second arm of the handle. The draw bar pin may include a first end and a second end. The first end of the draw bar pin is preferably fixedly secured to the inner face of the first arm of the handle and the second end of the draw bar pin is preferably fixedly secured to the inner face of the second arm of the handle.

It is preferred that the draw bar pin cutout of the draw bar includes a main longitudinally extending slot and at least two offshoot draw bar pin receiving slots. The main longitudinally extending slot of the draw bar pin cutout of the draw bar is preferably capable of receiving a portion of the draw bar pin when the handle is placed in the sheet material display released position and permitting the draw bar pin to be selectively positioned within one of the at least two offshoot draw bar pin receiving slots before the handle is placed in the sheet material display tensioned position. Each of the at least two offshoot draw bar pin receiving slots is preferably capable of causing the draw bar to exert a different amount of tension to the sheet material display when the portion of the draw bar pin is received within the draw bar pin receiving slot and the handle is placed in the sheet material display tensioned position.

More preferably, the draw bar pin cutout of the draw bar includes a main longitudinally extending slot and at least three offshoot draw bar pin receiving slots. Each of the at least three offshoot draw bar pin receiving slots is preferably capable of causing the draw bar to exert a different amount of tension to the sheet material display when the portion of the draw bar pin is received within the draw bar pin receiving slot and the handle is placed in the sheet material display tensioned position.

The preferred embodiment may include a spring means having a central coiled section, a first U-shaped wire retainer section, and a second U-shaped wire retainer section. The central coiled section of the spring means may have a first end and a second end. The first U-shaped wire retainer section of the spring means may extend from the first end of the central coiled section of the spring means. The second wire retainer section of the spring means may extend from the second end of the central coiled section of the spring means.

Preferably, the first wire retainer section of the spring means is detachably secured to the draw bar. More preferably, the draw bar includes a first U-shaped wire retainer section bore for detachably securing the first U-shaped wire retainer section of the spring means to the draw bar. A portion of the first U-shaped wire retainer section of the spring means may be looped through the first U-shaped wire retainer section bore of the draw bar.

The preferred embodiment may include a chain (preferably a linked chain) having a first end detachably connected to the second wire retainer section of the spring means and a second end detachably connected to an S-hook. The S-hook is preferably capable of being detachably secured to the sheet material display. More preferably, the S-hook is capable of being detachably connected to a connecting rod partially hemmed into the sheet material display at an outer edge thereof. The S-hook is also preferably capable of being looped around the connecting rod and attached to a second area of the chain.

In the preferred embodiment, it is further preferred that the first arm of the handle contain a first handle locking pin bore and the second arm of the handle contain a corresponding first handle locking pin bore. The first arm of the handle may contain a second handle locking pin bore and the second arm of the handle may contain a corresponding second handle locking pin bore. A handle locking pin is provided which is preferably capable of being inserted through the first handle locking pin bore of the first arm of the handle and the first handle locking pin bore of the second arm of the handle or alternatively through the second handle locking pin bore of the first arm of the handle and the second handle locking pin bore of the second arm of the handle to prevent the handle from being placed in the sheet material released position once the handle is placed in the sheet material display tensioned position.

The present invention is also directed to a novel method of retaining and selectively tensioning a sheet material display on a billboard. The method includes the step of providing at least one apparatus for retaining and selectively tensioning the sheet material display on the billboard as described hereinabove.

The method may include the step of placing the message portion of the sheet material display on the front face of the billboard. The sheet material display preferably has at least one connecting rod hemmed into the sheet material display at the outer edge thereof and partially exposed. The outer edge of the sheet material display containing the at least one connecting rod is preferably capable of extending to the back face of the billboard when the message portion of the sheet material display is placed on the front face of the billboard.

The method may include the step of affixing the base plate of the apparatus to the back face of the billboard. When the base plate of the apparatus is affixed to the back face of the billboard, the handle of the apparatus is preferably in the sheet material display released position with a portion of the draw bar pin being received within the main longitudinally extending slot of the draw bar pin cutout of the draw bar of the apparatus.

Preferably, the base plate of the apparatus is affixed to the back face of the billboard by welding, e.g. tack welding. The base plate can also be detachably affixed to the back face of the billboard using at least two screw bores in the base plate and two screws. The two separate screws are preferably placed in each respective screw bore hole of the base plate of the apparatus and tightened.

The method may include the step of detachably connecting the S-hook of the apparatus to the at least one connecting rod of the sheet material display. Alternatively, the S-hook of the apparatus may be looped around the connecting rod of the sheet material display and detachably connected to a second area of the chain.

The method may include the step of selectively positioning the portion of the draw bar pin of the apparatus within one of the at least two offshoot draw bar pin receiving slots of the draw bar of the apparatus.

The method may include the step of placing the handle into the sheet material display tensioned position, which causes the sheet material display to be retained and tensioned on the billboard.

In a preferred embodiment of the method, the apparatus is provided wherein the first arm of the handle contains a first handle locking pin bore and the second arm of the handle contains a corresponding first handle locking pin bore. The first arm of the handle contains a second handle locking pin bore and the second arm of the handle contains a corresponding second handle locking pin bore. The method preferably includes the step of inserting a handle locking pin either through the first handle locking pin bore of the first arm of the handle and the first handle locking pin bore of the second arm of the handle or through the second handle locking pin bore of the first arm of the handle and the second handle locking pin bore of the second arm of the handle. This prevents the handle from being accidentally or inadvertently placed in the sheet material released position once the handle is placed in the sheet material display tensioned position.

The objects and advantages of the present invention including those mentioned above and others will be readily apparent to one skilled in the art to which the invention pertains from a perusal of the claims and the following detailed description of preferred embodiments when read in conjunction with the appended drawings.

DETAILED DESCRIPTION OF PREFERRED EMBODIMENTS OF INVENTION

FIGS. 1-11 illustrate a preferred embodiment of apparatus 10 for retaining and selectively tensioning sheet material display 11 on billboard 12. All component parts of apparatus 10 are preferably made from durable metal and more preferably made from steel.

Figure 1:
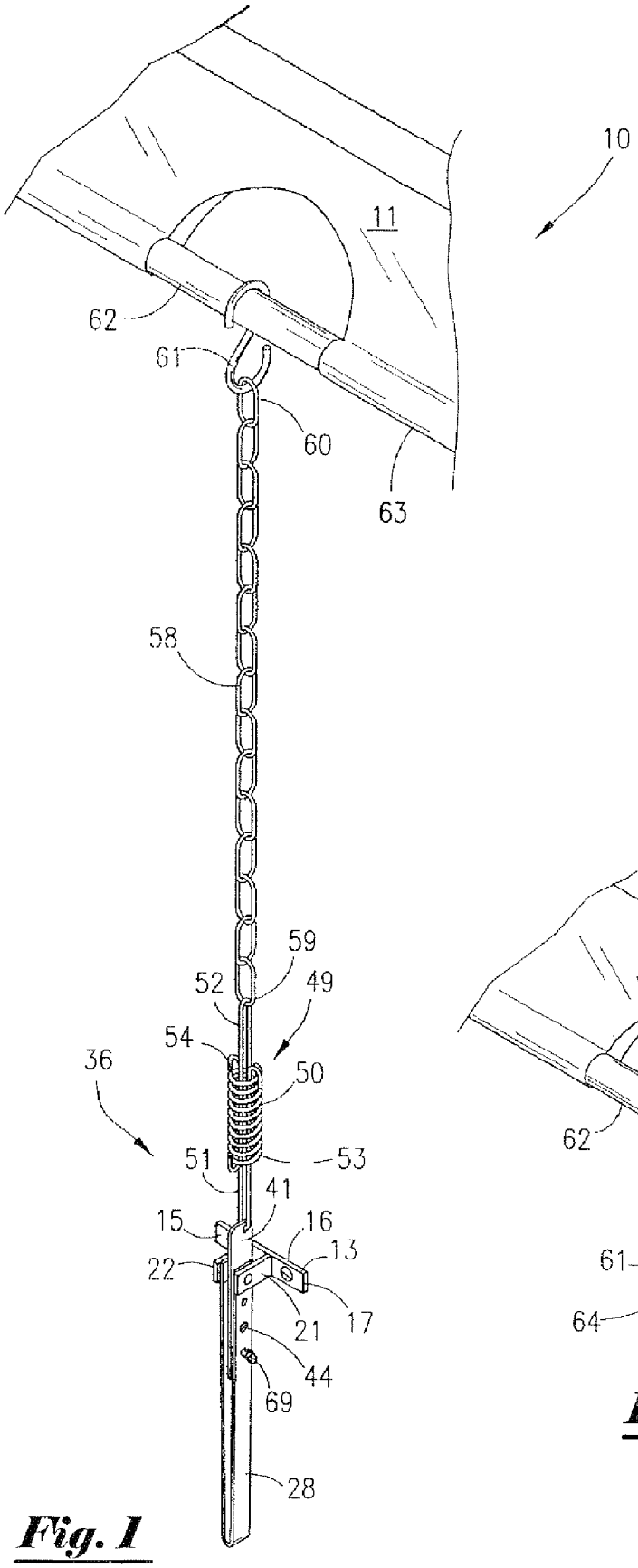
FIG. 1 is a perspective view of a preferred embodiment of the apparatus of the present invention showing the handle placed in the sheet material display tensioned position and showing the S-hook detachably connected to the connecting rod.
Figure 11:
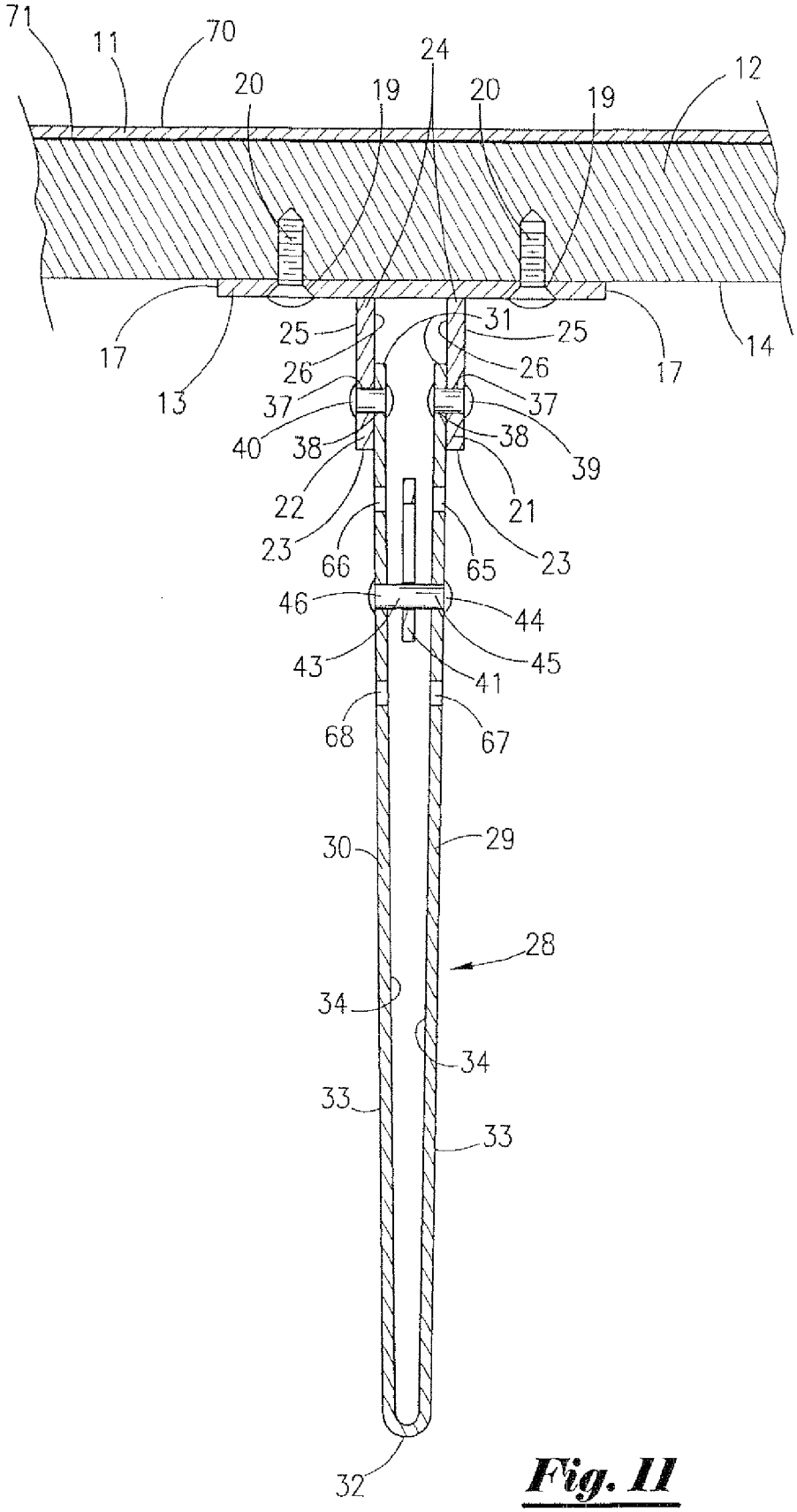
FIG. 11 is a cross-sectional view of the preferred embodiment of the apparatus of the present invention taken generally along line 11-11 of FIG. 5.

As shown in FIGS. 1 and 11, apparatus 10 may include base plate 13. Base plate 13 is preferably capable of being affixed to back face 14 of billboard 12. Base plate 13 may have top face 15, bottom face 16, and four interconnected side walls 17.

Base plate 13 may be temporarily or permanently mounted to back face 14 of billboard 12, preferably on the supporting structure thereof. Base plate 13 should be installed on back face 14 approximately 24" to 30" from side walls 17 of billboard 12. For those apparatus 10 which will be used to retain and selectively tension the bottom edge of sheet material display 11, base plate 13 of apparatus 10 should preferably be mounted to a hanging bar, catwalk, catwalk support or up-rights.

In those instances where the supporting structure of back face 14 is metal, base plate 13 may be welded to back face 14, preferably by tack welding.

Base plate 13 can also be detachably affixed to back face 14. In those instances where the supporting structure of back face 14 is composed of wood or metal, base plate 13 can be detachably affixed to back face 14 by screws. Preferably, base plate 13 includes at least one screw bore 19 therein. Screw bore 19 is preferably capable of permitting placement of screw 20 therein, tightening of screw 20, and retention of a portion of the screw 20 to cause base plate 13 to be detachably affixed to back face 14 of billboard 12. More preferably, base plate 13 includes at least two screw bores 19 therein. Each of screw bores 19 are preferably capable of permitting placement of screw 20 therein, tightening of screw 20, and retention of a portion of screw 20 to cause base plate 13 to be detachably affixed to back face 14 of billboard 12.

Base plate 13 can be of varied design and dimensions. Preferably, base plate 13 is rectangular with dimension of about 1" by about 4" by about 3/16".

Figure 10:
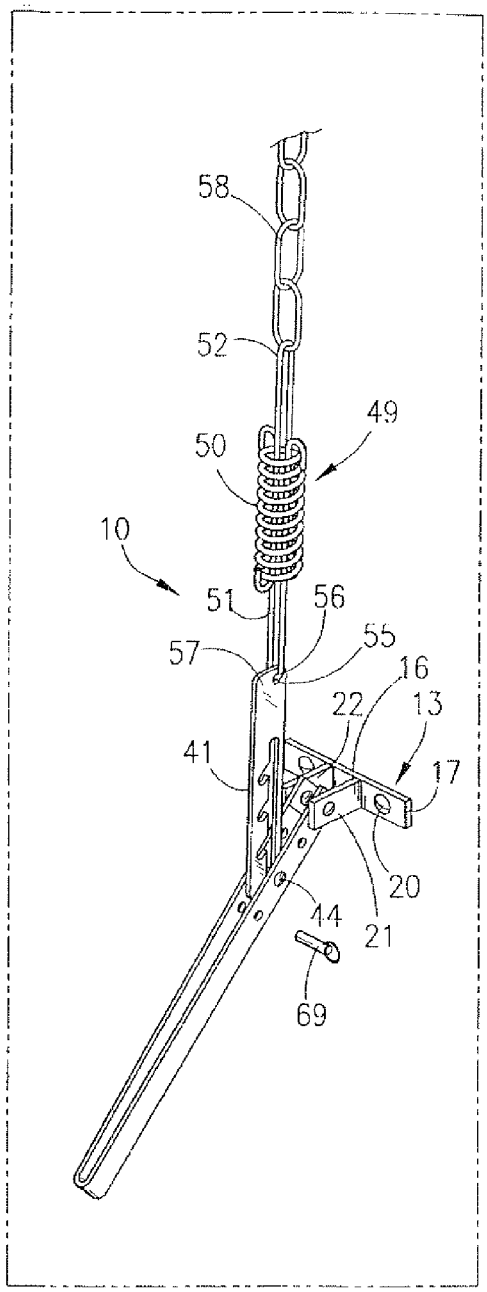
FIG. 10 is a partial perspective, partial exploded view of the preferred embodiment of the apparatus of the present invention showing the handle placed in the sheet material display released position and showing the draw bar pin received within the main longitudinally extending slot of the handle locking pin.

FIGS. 1, 10, and 11 show that apparatus 10 may include first and second handle connecting brackets 21, 22. Each of first and second handle connecting brackets 21, 22 may have distal end 23, proximal end 24, outer face 25, inner face 26, and four interconnecting side walls 27. Proximal end 24 of each of first and second handle connecting brackets 21, 22 may be fixedly attached (e.g. by welding) to top face 15 of base plate 13 so that first and second handle connecting brackets 21, 22 are positioned perpendicular to base plate 13 in spaced-apart, parallel relation.

First and second handle connecting brackets 21, 22 may be of varied design and dimensions. Preferably, each of first and second handle connecting brackets 21, 22 is rectangular with dimension of about 1" by about 1 9/16" by about 3/16".

Again with reference to FIGS. 1, 10, and 11, apparatus 10 may include U-shaped handle 28 which preferably has first and second arms 29, 30. Each of first and second arms 29, 30 preferably has distal end 31, proximal end 32, outer face 33, and inner face 34. Distal end 31 of first arm 29 of handle 28 is preferably pivotally connected to distal end 23 of first handle connecting bracket 21 and distal end 31 of second arm 30 of handle 28 is preferably pivotally connected to distal end 23 of second handle connecting bracket 22 so that handle 28 is capable of being pivoted from sheet material display released position 35 to sheet material display tensioned position 36 as shown in FIGS. 3-9.

Distal end 23 of each of first and second handle connecting brackets 21, 22 contains rivet bore hole 37 and distal end 31 of each of first and second arms 29, 30 of handle 28 contains corresponding rivet bore hole 38. Rivet bore hole 37 of distal end 23 of first handle connecting bracket 21 is preferably aligned with corresponding rivet bore hole 38 of distal end 31 of first arm 29 of handle 28. Rivet bore hole 37 of distal end 23 of second handle connecting bracket 22 is preferably aligned with corresponding rivet bore hole 38 of distal end 31 of second arm 30 of handle 28. First rivet 39 may be provided with a portion passing through rivet bore hole 37 of distal end 23 of first handle connecting bracket 21 and corresponding rivet bore hole 38 of distal end 31 of first arm 29 of handle 28 to pivotally connect distal end 31 of first arm 29 of handle 28 to distal end 23 of first handle connecting bracket 21. Second rivet 40 may be provided with a portion passing through rivet bore hole 37 of distal end 23 of second handle connecting bracket 22 and corresponding rivet bore hole 38 of distal end 31 of second arm 30 of handle 28 to pivotally connect distal end 31 of second arm 30 of handle 28 to distal end 23 of second handle connecting bracket 22.

The dimension of handle 28 can vary. Preferably, handle 28 is about 3/4" by about 10 3/4." Rival bore holes 37, 38 may each be about 1/4." Rivets 39, 40 are each preferably about 1/4."

As illustrated in FIGS. 1 and 3-11, draw bar 41 may be operationally associated with handle 28. Draw bar 41 is preferably at least partially positioned between inner face 34 of first arm 29 of handle 28 and inner face 34 of second arm 30 of handle 28. Draw bar 41 may have draw bar pin cutout 42 for receiving portion 43 of draw bar pin 44.

Preferably, draw bar pin 44 extends from inner face 34 of first arm 29 of handle 28 through draw bar pin cutout 42 of draw bar 41 to inner face 34 of second arm 30 of handle 28. Draw bar pin 44 may include first end 45 and second end 46. First end 45 of draw bar pin 44 is preferably fixedly secured (e.g. by welding) to inner face 34 of first arm 29 of handle 28 and second end 46 of draw bar pin 44 is preferably fixedly secured (e.g. by welding) to inner face 34 of second arm 30 of handle 28.

As shown in FIGS. 3-10, draw bar pin cutout 42 of draw bar 41 may include main longitudinally extending slot 47 and at least two offshoot draw bar pin receiving slots 48. Main longitudinally extending slot 47 of draw bar pin cutout 42 of draw bar 41 may receive portion 43 of draw bar pin 44 when handle 28 is placed in sheet material display released position 35. Main longitudinally extending slot 47 acts to permit draw bar pin 44 to be selectively positioned within one of at least two offshoot draw bar pin receiving slots 48 before handle 28 is placed in sheet material display tensioned position 36. Each of at least two offshoot draw bar pin receiving slots 48 is preferably capable of causing draw bar 41 to exert a different amount of tension to sheet material display 11 when portion 43 of draw bar pin 44 is positioned within draw bar pin receiving slot 48 and handle 28 is placed in sheet material display tensioned position 36.

More preferably, draw bar pin cutout 42 of draw bar 41 includes main longitudinally extending slot 47 and at least three offshoot draw bar pin receiving slots 48. Each of at least three offshoot draw bar pin receiving slots 48 is preferably capable of causing draw bar 41 to exert a different amount of tension to sheet material display 11 when portion 43 of draw bar pin 44 is positioned within draw bar pin receiving slot 48 and handle 28 is placed in sheet material display tensioned position 36.

It is preferred that draw bar pin 44 be rectangular with the dimensions of about 1" by about 6" by about ⅛." Main longitudinally extending slot 47 is preferably about 9/32" by about 3 13/16." Each offshoot draw bar pin receiving slot 48 is about 9/32" by about 11/32."

As shown in FIGS. 1 and 10, apparatus 10 may have spring means 49 having central coiled section 50, a first U-shaped wire retainer section 51, and second U-shaped wire retainer section 52. Central coiled section 50 of spring means 49 may have first end 53 and second end 54. First U-shaped wire retainer section 51 of spring means 49 may extend from first end 53 of central coiled section 50 of spring means 49. Second wire retainer section 52 of spring means 49 may extend from second end 52 of central coiled section 50 of spring means 49. First wire retainer section 51 of spring means 49 is preferably detachably secured to draw bar 41. Spring means 49 is preferably about 7" in length.

Spring means 49 functions to keep tension on draw bar 41 and handle 28 to secure handle 28 in sheet material display tensioned position 36 at or past 180° and thus provide a self-locking mechanism. When handle 28 is in sheet material display tensioned position 36, spring means 49 also acts as a regulator permitting some movement of sheet material display 11 to prevent wrinkles from occurring therein. This will also extend the life of sheet material display 11 in hostile conditions such as storms and high winds. Spring means 49 and its component parts, central coiled section 50, first U-shaped wire retainer section 51, and second U-shaped wire retainer section 52, can be changed out to become stronger and more flexible. Of importance, first and second U-shaped wire retainer sections 51, 52 of spring means 49 are the break away point in apparatus 10 if the stress is greater than what was designed for apparatus 10 to carry. It should also be understood that first and second U-shaped wire retainer sections 51, 52 can be pinched together at the open ends and pulled back through central coiled section 50 to re-position chain 58 for the ideal reach to connecting rod 62 thereby minimizing further adjustments to apparatus 10.

As shown in FIGS. 1 and 10, draw bar 41 preferably includes first U-shaped wire retainer section bore 55 (e.g. about a ¼" bore) for detachably securing first U-shaped wire retainer section 51 of spring means 49 to draw bar 41. More preferably, a portion 56 of first U-shaped wire retainer section 51 of spring means 49 is looped through first U-shaped wire retainer section bore 55 of draw bar 41. It is preferred that first U-shaped wire retainer section bore 55 be located off center at end 57 of draw bar 41. By placing first U-shaped wire retainer section bore 55 off center, the tension applied to draw bar 41 and handle 28 when handle 28 is in sheet material display tensioned position 36 causes handle 28 to be self-locking, particularly when handle 28 is situated past 180° in sheet material display tensioned position 36.

Again as shown in FIG. 1, apparatus 10 may include chain 58 (preferably a linked chain) having first end 59 detachably connected to second wire retainer section 52 of spring means 49 and second end 60 detachably connected to S-hook 61. S-hook 61 is preferably capable of being detachably secured to sheet material display 11. More preferably, S-hook 61 is capable of being detachably connected to connecting rod 62 partially hemmed into sheet material display 11 at outer edge 63 thereof.

Chain 58 is preferably about a 2' 0" straight link chain. S-hook 61 is preferably about a ¼" S-hook having a length of about 4".

Figure 2:
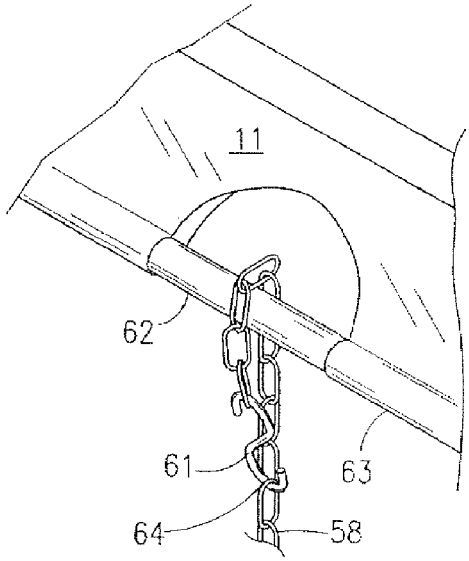
FIG. 2 is a partial perspective view of the preferred embodiment of the apparatus of the present invention showing the S-hook looped around the connecting rod and detachably connected to a second area of the chain.
Figure 3:
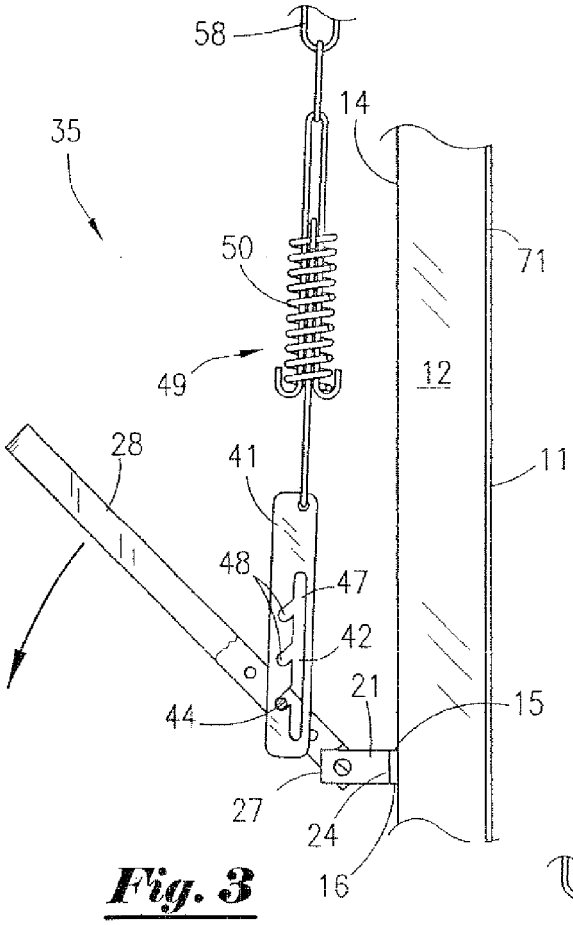
FIG. 3 is partial, cut-away, side-view of the preferred embodiment of the apparatus of the present invention showing the handle placed in the sheet material display released position and with the draw bar pin received within the third offshoot draw bar pin receiving slot.
Figure 4:
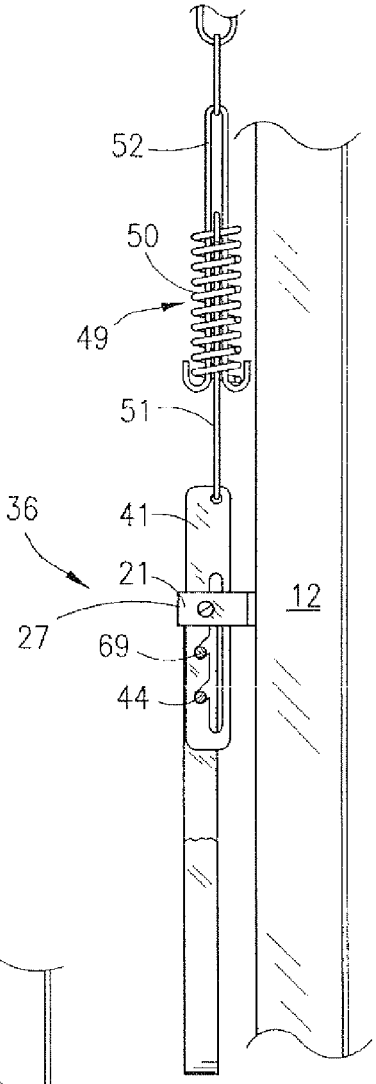
FIG. 4 is partial, cut-away, side-view of the preferred embodiment of the apparatus of the present invention showing the handle placed in the sheet material display tensioned position and showing the draw bar pin received within the third offshoot draw bar pin receiving slot and the handle locking pin passing through the second offshoot draw bar pin receiving slot.
Figure 5:
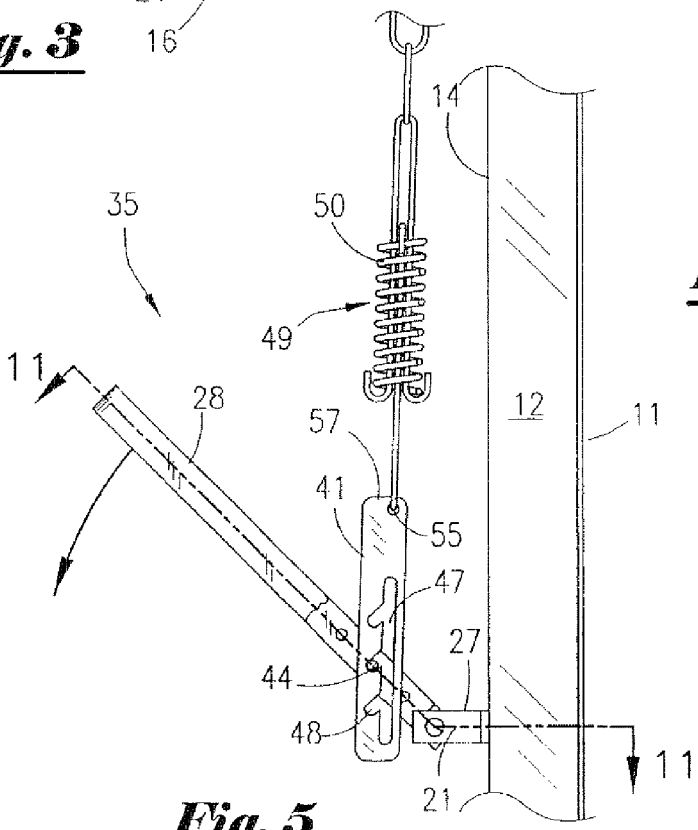
FIG. 5 is partial, cut-away, side-view of the preferred embodiment of the apparatus of the present invention showing the handle placed in the sheet material display released position and showing the draw bar pin received within the second offshoot draw bar pin receiving slot.
Figure 6:
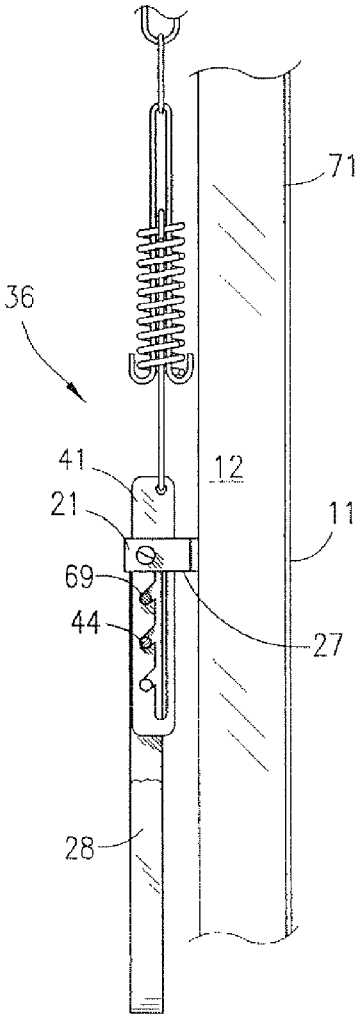
FIG. 6 is partial, cut-away, side-view of the preferred embodiment of the apparatus of the present invention showing the handle placed in the sheet material display tensioned position and showing the draw bar pin received within the second offshoot draw bar pin receiving slot and the handle locking pin passing through the first offshoot draw bar pin receiving slot.
Figure 7:
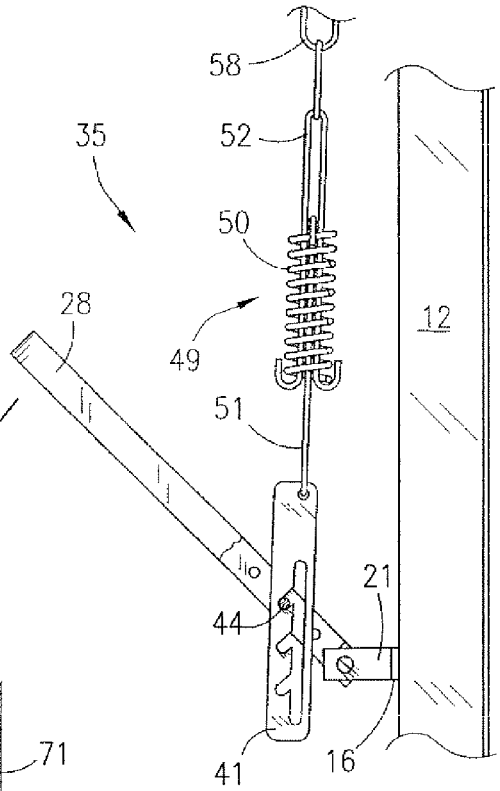
FIG. 7 is partial, cut-away, side-view of the preferred embodiment of the apparatus of the present invention showing the handle placed in the sheet material display released position and showing the draw bar pin received within the first offshoot draw bar pin receiving slot.
Figure 8:
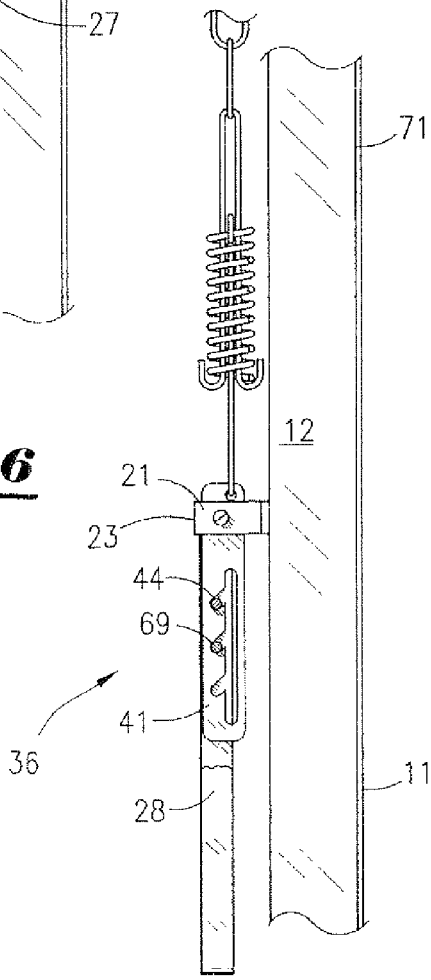
FIG. 8 is partial, cut-away, side-view of the preferred embodiment of the apparatus of the present invention showing the handle placed in the sheet material display tensioned position and showing the draw bar pin received within the first offshoot draw bar pin receiving slot and the handle locking pin passing through the second offshoot draw bar pin receiving slot.

As illustrated in FIG. 2, S-hook 61 is also preferably capable of being looped around connecting rod 62 and attached to second area 64 of chain 58.

FIGS. 1, 4, 6, 8, 10, and 11 reveal that first arm 29 of handle 28 may contain first handle locking pin bore 65 and second arm 30 of handle 28 may contain corresponding first handle locking pin bore 66. First arm 29 of handle 28 may contain second handle locking pin bore 67 and second arm 30 of handle 28 contains corresponding second handle locking pin bore 68. Each of first handle locking pin bores 65, 66 and second handle locking pin bores 67, 68 is preferably about a ¼" bore, which are each preferably positioned about 1" from the point where respective first and second ends 45, 46 of draw bar pin 44 connects to respective first and second arms 29, 30 of handle 28.

Handle locking pin 69 is provided which is preferably capable of being inserted through first handle locking pin bore 65 of first arm 29 of handle 28 and first handle locking pin bore 66 of second arm 30 of handle 28 or alternatively through second handle locking pin bore 67 of first arm 29 of handle 28 and second handle locking pin bore 68 of second arm 30 of handle 28 to prevent handle 28 from being placed in sheet material released position 35 once handle 28 is placed in sheet material display tensioned position 36. Handle locking pin 69 may be any type of pin locking device.

Figure 9:
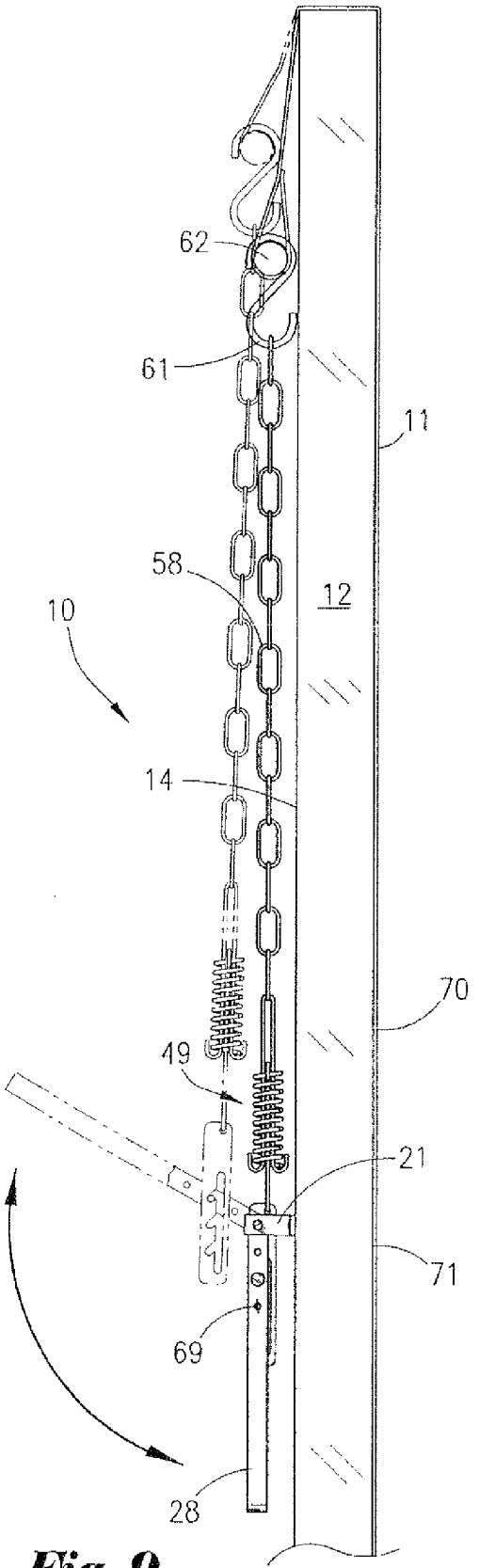
FIG. 9 is a phantom side view of the preferred embodiment of the apparatus of the present invention showing the handle placed in both the sheet material display released position (shown in phantom) and the sheet material display tensioned position (shown in non-phantom).

With reference to FIG. 9, apparatus 10 may be used in a method to retain and selectively tension sheet material display 11 on billboard 12. First, at least one apparatus 10 may be provided. Message portion 70 of sheet material display 11 is placed on front face 71 of billboard 12. Sheet material display 11 preferably has at least one connecting rod 62 hemmed into sheet material display 11 at outer edge 63 thereof and partially exposed. Outer edge 63 of sheet material display 11 containing at least one connecting rod 62 is preferably capable of extending to back face 14 of billboard 12 when message portion 70 of sheet material display 11 is placed on front face 71 of billboard 12.

Base plate 13 of apparatus 10 is preferably affixed to back face 14 of the billboard 12. When base plate 13 of apparatus 10 is affixed to back face 14 of billboard 12, handle 28 of apparatus 10 is preferably in sheet material display released position 35 with portion 43 of draw bar pin 44 being received and positioned within main longitudinally extending slot 47 of draw bar pin cutout 42 of draw bar 41 of apparatus 10.

Preferably, base plate 13 may be affixed to back face 14 by welding. More preferably, base plate 13 of apparatus 10 is detachably affixed to back face 14 of billboard 12 using at least two screw bores 19 in base plate 13 and two screws 20. Separate screws 20 are preferably placed in each screw bore hole 19 of base plate 13 of apparatus 10 and tightened.

The method further includes detachably connecting S-hook 61 of apparatus 10 to at least one connecting rod 62 of sheet material display 11. Alternatively, S-hook 61 of apparatus 10 may be looped around connecting rod 62 of sheet material display 11 and detachably connected to second area 64 of chain 58.

The method also includes selectively positioning draw bar 41 about handle 28 so that one of at least two offshoot draw bar pin receiving slots 48 of draw bar 41 of apparatus 10 receive portion 43 of draw bar pin 44.

The method also includes placing handle 28 into sheet material display tensioned position 36, which causes sheet material display 11 to be retained and tensioned on billboard 12.

In the preferred embodiment of apparatus 10 wherein first arm 29 of handle 28 contains first handle locking pin bore 65 and second arm 30 of handle 28 contains corresponding first handle locking pin bore 66, and first arm 29 of handle 28 contains second handle locking pin bore 67 and second arm 30 of handle 28 contains corresponding second handle locking pin bore 68, the method preferably includes the step of inserting handle locking pin 69 through first handle locking pin bore 65 of first arm 29 of handle 28 and first handle locking pin bore 66 of second arm 30 of handle 28 or alternatively through second handle locking pin bore 67 of first arm 29 of handle 28 and second handle locking pin bore 68 of second arm 30 of handle 28. This prevents handle 28 from being accidentally or inadvertently placed in sheet material released position 35 once handle 28 is placed in sheet material display tensioned position 36.

While preferred embodiments of the present invention have been described, it is to be understood that the embodiments described are illustrative only and that the scope of the invention is to be defined solely by the appended claims when accorded a full range of equivalence, many variations and modifications naturally occurring to those skilled in the art from a perusal hereof.

What is claimed is:

1. A method of retaining and selectively tensioning a sheet material display on a billboard, comprising the steps of:

a) providing at least one apparatus for retaining and selectively tensioning said sheet material display on said billboard, said apparatus comprising:

a base plate capable of being affixed to a back face of said billboard, said base plate having a top face, a bottom face, and four interconnected side walls;

a first and second handle connecting brackets, each of said first and second handle connecting brackets having a distal end, a proximal end, an outer face, an inner face, and four interconnecting side walls, said proximal end of each of said first and second handle connecting brackets being fixedly attached to said top face of said base plate so that said first and second handle connecting brackets are positioned perpendicular to said base plate in spaced-apart, parallel relation;

a U-shaped handle having a first and second arms, each of said first and second arms having a distal end, a proximal end, an outer face, and an inner face, said distal end of said first arm of said handle being pivotally connected to said distal end of said first handle connecting bracket and said distal end of said second arm of said handle being pivotally connected to said distal end of said second handle connecting bracket so that said handle is capable of being pivoted from a sheet material display released position to a sheet material display tensioned position;

a draw bar operationally associated with said handle, said draw bar being at least partially positioned between said inner face of said first arm of said handle and said inner face of said second arm of said handle, said draw bar having a draw bar pin cutout for receiving a portion of said draw bar pin, said draw bar pin cutout being capable of causing said draw bar to be movably positioned about said handle in at least two different positions, each of said at least two different positions capable of causing said draw bar to exert a different amount of tension to said sheet material display when said handle is placed in said sheet material display tensioned position, said draw bar pin extending from said inner face of said first arm of said handle through said draw bar pin cutout of said draw bar to said inner face of said second arm of said handle, said draw bar pin including a first end and a second end, said first end of said draw bar pin being fixedly secured to said inner face of said first arm of said handle and said second end of said draw bar pin being fixedly secured to said inner face of said second arm of said handle;

a spring means having a central coiled section, a first U-shaped wire retainer section, and a second U-shaped wire retainer section, said central coiled section of said spring means having a first end and a second end, said first U-shaped wire retainer section of said spring means extending from said first end of said central coiled section of said spring means and said second wire retainer section of said spring means extending from said second end of said central coiled section of said spring means, said first wire retainer section of said spring means being detachably secured to said draw bar; and a chain having a first end detachably connected to said second wire retainer section of said spring means and a second end detachably connected to an S-hook, said S-hook capable of being detachably secured to said sheet material display;

wherein said draw bar pin cutout of said draw bar comprises a main longitudinally extending slot and at least two offshoot draw bar pin receiving slots, said main longitudinally extending slot of said draw pin cutout of said draw bar receiving said portion of said draw bar pin when said handle is placed in said sheet material display released position and permitting said draw bar pin to be selectively positioned within one of said at least two offshoot draw bar pin receiving slots before said handle is placed in said sheet material display tensioned position, each of said at least two offshoot draw bar pin receiving slots capable of causing said draw bar to exert a different amount of tension to said sheet material display when said portion of said draw bar pin is positioned within said draw bar pin receiving slot and said handle is placed in said sheet material display tensioned position;

b) placing a message portion of said sheet material display on a front face of said billboard, said sheet material display having at least one connecting rod partially hemmed into said sheet material display at an outer edge thereof; said outer edge of said sheet material display containing said at least one connecting rod capable of extending to said back face of said billboard when said sheet material display is placed on said front face of said billboard;

c) affixing said base plate of said apparatus to said back face of said billboard, wherein upon affixing said base plate of said apparatus to said back face of said billboard, said handle of said apparatus is in said sheet material display released position with said portion of said draw bar pin being received within said main longitudinally extending slot of said draw bar pin cutout of said draw bar of said apparatus;

d) detachably connecting said S-hook of said apparatus to said at least one connecting rod of said sheet material display;

e) selectively positioning said draw bar about said handle so that one of said at least two offshoot draw bar pin receiving slots of said draw bar receives said portion of said draw bar pin of said apparatus; and f) placing said handle of said apparatus into said sheet material display tensioned position.

2. The method according to claim 1, wherein in step (d) said S-hook of said apparatus is looped around said connecting rod of said sheet material display and detachably connected to a second area of said metal chain.

3. The method according to claim 1, wherein said base plate of said apparatus is affixed to said back face of said billboard by welding.

4. The method according to claim 1, wherein said base plate of said apparatus includes at least two screw bores therein and in step (c) said base plate is detachably affixed to said back face of said billboard by placing a separate screw in each screw bore hole of said base plate of said apparatus and tightening each of said screws.

5. The method according to claim 1, wherein said first arm of said handle contains a first handle locking pin bore and said second arm of said handle contains a corresponding first handle locking pin bore, said first arm of said handle contains a second handle locking pin bore and said second arm of said handle contains a corresponding second handle locking pin bore, said method further comprising the step of:

g) inserting a handle locking pin through said first handle locking pin bore of said first arm of said handle and said first handle locking pin bore of said second arm of said handle or through said second handle locking pin bore of said first arm of said handle and said second handle locking pin bore of said second arm of said handle to prevent said handle from being placed in said sheet material released position once said handle is placed in said sheet material display tensioned position.

* * * * *